US006764554B2

(12) United States Patent
Gavén

(10) Patent No.: US 6,764,554 B2
(45) Date of Patent: Jul. 20, 2004

(54) REFINING ELEMENT FOR A REFINING DISK

(75) Inventor: Jan-Åke Gavén, Hagfors (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 10/221,253

(22) PCT Filed: Feb. 19, 2001

(86) PCT No.: PCT/SE01/00362

§ 371 (c)(1),
(2), (4) Date: Sep. 10, 2002

(87) PCT Pub. No.: WO01/68260

PCT Pub. Date: Sep. 20, 2001

(65) Prior Publication Data

US 2003/0024614 A1 Feb. 6, 2003

(30) Foreign Application Priority Data

Mar. 15, 2000 (SE) ..... 0000879

(51) Int. Cl.[7] ..... C22C 38/36; C22C 38/24

(52) U.S. Cl. ..... 148/324; 420/15; 420/16; 420/17

(58) Field of Search ..... 148/324; 420/15, 420/16, 17

(56) References Cited

U.S. PATENT DOCUMENTS

| | | | |
|---|---|---|---|
| 4,023,739 | A | 5/1977 | Lampe et al. |
| 4,765,836 | A | 8/1988 | Hauser et al. |

FOREIGN PATENT DOCUMENTS

| | | |
|---|---|---|
| SE | 402 019 | 10/1976 |
| SE | 506 822 C2 | 12/1997 |

OTHER PUBLICATIONS

Abstract of SU 1663042.

*Primary Examiner*—Deborah Yee
(74) *Attorney, Agent, or Firm*—Lerner, David, Littenberg, Krumholz & Mentlik, LLP

(57) ABSTRACT

Refining elements for refining discs for disc refiners for the manufacture of mechanical pulp are disclosed, having improved wear resistance by utilizing alloys with precipitated carbides. An improved service life is obtained with a refining disk having the following analysis in % by weight: 2.96 C, 0.77 Si, 0.82 Mn, 24.2 Cr, 5.16 v, 0.04 Ni, 0.03 Mo, and the reminder Fe and impurities. After casting, the refining segments are hardened and annealed and assume a hardness of 57–63 HRC.

6 Claims, No Drawings

REFINING ELEMENT FOR A REFINING DISK

FIELD OF THE INVENTION

This invention relates to refining elements for a refining disc for disc-refiners intended for the manufacture and/or treatment of fibrous pulps, where the refining element is produced by casting a steel alloy and hardened and heat treated to a hardness of at least 55 HRC.

BACKGROUND OF THE INVENTION

Disc-refiners for the refining of lignocellulosic material, i.e. for the mechanical manufacture or treatment of so-called mechanical pulp, are known, for example, through Swedish Patent Nos. 506,822 and 402,019. These disk-refiners comprise two circular refining discs, which are rotated relative to each other, and have refining surfaces built-up of refining elements (normally called refining segments), which comprise bars and grooves and guide the pulp from the center out to the periphery during the refining operation. The refining surfaces are subjected to heavy abrasive wear due to hard foreign particles, such as sand, in the chips. In addition, the temperature is also high, often about 220° C., and the wood yields an acid pulp with a pH, which during the manufacture of newsprint is about 6.5, but which during board manufacture is as low as 4–5, which requires corrosion resistance. In order to reduce the wear, alloys with precipitated carbides are used.

One of the objects of the present invention is to thus provide refining elements of the aforedescribed kind, which have an improved service life.

SUMMARY OF THE INVENTION

In accordance with the present invention, these and other objects have now been realized by the invention of a refining element for use in a refining disk in disk refiners for the treatment of fibrous pulp material, the refining element comprising a heat-treated cast steel alloy having a hardness of at least 55 HRC and comprising from about 2.7 to 3.2 percent by weight C, from about 0.5 to 1.0 percent by weight Si, from about 0.7 to 1.2 percent by weight Mn, from about 21.0 to 26.0 percent by weight Cr, from about 3.0 to 6.0 percent by weight V, up to about 0.5 percent by weight Ni, and up to about 0.5 percent by weight Mo. In a preferred embodiment of the refining element of the present invention, the remaining composition of the refining element comprises iron and impurities.

In another embodiment of the refining element of the present invention, the refining element comprises from about 2.8 to 3.1 percent by weight of the C.

In another embodiment of the refining element of the present invention, the refining element comprises from about 0.7 to 1.0 percent by weight of the Si.

In another embodiment of the refining element of the present invention, the refining element of comprises from about 22.0 to 25.0 percent by weight of the Cr, and preferably from about 23.0 to 24.5 percent by weight of the Cr.

Vanadium is a very strong carbide former with a considerably greater affinity to carbon than chromium and the vanadium carbide has a hardness, which clearly exceeds that of the chromium carbide. Already the solidification, precipitation of vanadium carbides is obtained which improves both the wear resistance abrasive wear, the corrosion resistance. The corrosion resistance is understood and explained in that every percent of vanadium binds up to 0.23% carbon. As a result, carbon content in the matrix decreases to a corresponding extent, which has the consequence that the carbon content available for chromium for the formation of carbides becomes lower. The chromium carbides, which are precipitated, contain also a certain amount of vanadium. Therefore, the proportion of chromium substitution dissolved in the matrix, which improves the corrosion resistance, increases. Due to the adapted contents of carbon, chromium and vanadium the primary precipitated carbides assume a desired size, so that the tenacity is not reduced thereby such that the primary precipitated carbides are too great. The fracture surfaces of the alloys according to the present invention are considerably more fine-grained than of the other chromium-alloyed casting alloys for refining elements. A material is thus obtained which has both improved resistance to abrasive wear and improved corrosion resistance. This is particularly important for refining segments, which are intended to be used for the refining of board pulp.

In order to achieve sufficient hardness of above 55 HRC, and preferably from about 57 to 63 HRC, after hardening and heat treatment, the hardenability must be sufficient. Therefore, the carbon content must be kept high, and if the stated analysis interval for the carbide forming elements Cr, Mo and V and for Ni are exceeded, the hardness will not be achieved. If the carbon content exceeds the stated analysis interval, the carbides grow and embrittle the material.

If the lower limits for Cr and V are not reached, the desired mixture of carbide types essential for the wear resistance is not obtained.

In order to achieve maximum wear resistance and tenacity, the material must be hardened and annealed in a conventional manner. In connection with this heat treatment a secondary carbide fraction is precipitated, which is more finely dispersed than the one obtained solidification.

EXAMPLE

An alloy according to the present invention was cast and heat treated and compared with two known alloys used for refining segments. The anlyses are shown in the following table, which also shows the results of the wear tests.

TABLE OF CHEMICAL COMPOSITION IN PER CENT BY WEIGHT AND RESULTS OF WEAR TESTS

| Alloy | C | Si | Mn | Cr | V | Mo | Ni | Wear (mg) |
|---|---|---|---|---|---|---|---|---|
| Alloy acc. to invention | 2.96 | 0.77 | 0.82 | 24.2 | 5.16 | 0.04 | 0.03 | 170 |
| Comparison alloy 1 | 1.12 | 0.89 | 0.93 | 16.70 | 0.19 | 0.61 | 0.13 | 260 |
| Comparison alloy 2 | 2.63 | 0.43 | 0.75 | 26.60 | 0.35 | 0.02 | 0.10 | 200 |

In order to be able to evaluate and rank the properties of the alloys, an abrasive wear test is used where a definite sample size of the metal samples is worn against grinding paper for a definite period and with a constant pressure. The tests were made in water of room temperature. The abrasive wear resistance was measured as weight loss in milligram. Of each alloy three sample pieces were made, and four tests of each sample piece were carried out. The mean values are shown in the Table above. The lower the weight loss, the greater, is the resistance to abrasive wear. The result cannot be directly converted into expected service life, because several parameters such as pH, temperature, rotation speed of the refiner, and others have an effect under the operation conditions. The test using laboratory environment has the advantage that one is not subjected to all imaginary variations arising during use in actual operation. As a completion, fullscale tests in operation were carried out with refining segments of the alloy according to the present invention, and a similar test with refining segments of comparison alloy 1. The refining segments had exactly the same surface pattern. The alloy according to the present invention had a service life which was 80% better than that of the comparison alloy.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A refining element for use in a refining disk in disk refiners for the treatment of fibrous pulp material, said refining element comprising a heat-treated cast steel alloy having a hardness of at least 55 HRC and comprising from about 2.7 to 3.2 percent by weight C, from about 0.5 to 1.0 percent by weight Si, from about 0.7 to 1.2 percent by weight Mn, from about 21.0 to 26.0 percent by weight Cr, from about 3.0 to 6.0 percent by weight V, up to about 0.5 percent by weight Ni, and up to about 0.5 percent by weight Mo.

2. The refining element of claim 1 wherein the remaining composition of said refining element comprises iron and impurities.

3. The refining element of claim 1 comprising from about 2.8 to 3.1 percent by weight of said C.

4. The refining element of claim 1 comprising from about 0.7 to 1.0 percent by weight of said Si.

5. The refining element of claim 1 comprising from about 22.0 to 25.0 percent by weight of said Cr.

6. The refining element of claim 1 comprising from about 23.0 to 24.5 percent by weight of said Cr.

* * * * *

UNITED STATES PATENT AND TRADEMARK OFFICE

CERTIFICATE OF CORRECTION

PATENT NO. : 6,764,554 B2
DATED : July 20, 2004
INVENTOR(S) : Jan-Åke Gavén

It is certified that error appears in the above-identified patent and that said Letters Patent is hereby corrected as shown below:

Column 1,
Line 64, “the” (second occurrence) should read -- during --
Line 66, after “resistance”, insert -- during --.
Line 66, “the” (second occurrence) should read -- and --.

Column 2,
Line 2, after “result” insert -- the --.
Line 6, “contain also” should read -- also contain --.
Line 36, after “obtained” insert -- during --.
Line 61, “of” should read -- at --.
Line 62, “milligram” should read -- milligrams --.
Line 66, after “greater” delete “,”.
Line 66, after “is” insert -- thus --.

Signed and Sealed this

Thirtieth Day of November, 2004

JON W. DUDAS
*Director of the United States Patent and Trademark Office*